United States Patent [19]

Ishihara et al.

[11] 4,296,276

[45] Oct. 20, 1981

[54] ROD-TYPE SYNTHETIC RESIN INSULATOR WITH OVERCOAT AND METAL FITTINGS

[75] Inventors: Takeshi Ishihara, Toyoake; Daisaku Goto, Konan; Hitoshi Sugiura, Toyohashi, all of Japan

[73] Assignee: NGK Insulators, Ltd., Nagoya, Japan

[21] Appl. No.: 127,038

[22] Filed: Mar. 4, 1980

[30] Foreign Application Priority Data

Nov. 17, 1979 [JP] Japan ..... 54-149317

[51] Int. Cl.[3] ..... H01B 17/02

[52] U.S. Cl. ..... 174/179; 174/186

[58] Field of Search ..... 174/140 S, 176, 177, 174/178, 179, 186

[56] References Cited

U.S. PATENT DOCUMENTS 3,898,372 8/1975 Kalb ..... 174/179

FOREIGN PATENT DOCUMENTS 1044196 11/1958 Fed. Rep. of Germany ..... 174/179

915052 1/1963 United Kingdom ..... 174/179

*Primary Examiner*—Laramie E. Askin

*Attorney, Agent, or Firm*—Stevens, Davis, Miller & Mosher

[57] ABSTRACT

A synthetic resin insulator comprising a fiber-reinforced plastic rod, metal fittings which hold both ends of the fiber-reinforced plastic rod, and a seamless unitary overcoat which consists of an elastic insulating material. The overcoat covers that part of the surface of the fiber-reinforced plastic rod located between the metal fittings. The external surface of the overcoat is formed into a plurality of sheds, and the metal fittings have metal sleeves pressed onto the end portions of the overcoat, so that those end portions are sandwiched between the metal sleeves and the fiber reinforced plastic rod. The elongation of the outer surface of the overcoat resulting from assembly with the fiber-reinforced plastic rod and pressing of the sleeves is not higher than 2%.

6 Claims, 13 Drawing Figures

ROD-TYPE SYNTHETIC RESIN INSULATOR WITH OVERCOAT AND METAL FITTINGS

BACKGROUND OF THE INVENTION (1) Field of the Invention

The present invention relates to an improvement of synthetic resin insulators comprising a fiber-reinforced plastic rod or pipe (hereinafter, referred to as reinforced plastic rod), an overcoat consisting of an elastic insulating material and metal fittings.

(2) Description of the Prior Art

A reinforced plastic rod produced by impregnating bundles of fibers arranged in their longitudinal direction or knitted fiber bundles with a synthetic resin and bonding the impregnated fiber bundles through the resin has a very high resistance against tensile stress and a very high ratio of strength to weight, but has low weather resistance and tracking resistance. However, elastic insulating materials, such as silicone rubber, ethylene propylene rubber and the like, have excellent weather resistance and tracking resistance. Recently, there have been made various investigations for producing synthetic resin insulators by combining these materials. As a typical synthetic resin insulator, there has been known an insulator comprising a reinforced plastic rod, holding metal fittings fixed to both ends of the rod, and a plurality of overcoats superposed one upon another and fitted with each other such that the overcoats cover the total surface of the reinforced plastic rod located between the holding metal fittings and the outer circumferential portion of the holding metal fitting at its end for receiving the reinforced plastic rod, each of the overcoats consisting of an elastic insulating material, such as ethylene propylene rubber or the like, having a given shape and being provided at its outside with one shed. In this insulator, in order to prevent formation of gaps at the interface between the reinforced plastic rod and the overcoats (hereinafter, interface between a reinforced plastic rod and an overcoat may be merely referred to as interface), or in order to seal the contact portion of adjacent overcoats, a pasty dielectric material, such as silicone grease or the like, is filled in the interface, or the reinforced plastic rod is bonded with the overcoats at the interface and adjacent overcoats are bonded with each other at the contact portion through an adhesive or the like. However, in these insulators, the contact portion of adjacent overcoats is eroded, and the pasty dielectric material filled in the interface leaks out through the contact portion, or water or the like in the external atmosphere penetrates into the interface through the contact portion, and insulation breakdown occurs at the interface, resulting in the breakdown of the insulator.

SUMMARY OF THE INVENTION

The object of the present invention is to obviate the above-described drawbacks of conventional synthetic resin insulators, and to provide a synthetic resin insulator having a low weight, a high strength and a high erosion resistance and capable of keeping its high electric insulation performance at the interface for a long period of time. That is, the feature of the present invention is the provision of a synthetic resin insulator, comprising a fiber-reinforced plastic rod, metal fittings which hold both ends of the fiber-reinforced plastic rod, and a seamless unitary overcoat which consists of an elastic insulating material, covers the total surface of the reinforced plastic rod located between the metal fittings and is provided at its outside with a plurality of sheds, said metal fittings having metal sleeves gastightly fixed thereto and being operative to receive both ends of the overcoat, both ends of said overcoat being sandwiched between the metal sleeve and the fiber-reinforced plastic rod and fixed and sealed in the metal sleeve by pressing the sleeve in the radial direction so as to isolate gastightly the interface between the overcoat and the fiber-reinforced plastic rod from the external atomsphere, the elongation of the outer surface of the overcoat resulting from assembly with the fiber-reinforced plastic rod and pressing of the sleeves being not higher than 2%.

DESCRIPTION OF THE PREFERRED EMBODIMENT

For an easy understanding of the synthetic resin insulator according to the present invention, an explanation will be made with respect to a typical conventional synthetic resin insulator referring to FIGS. 1 and 2.

Figure 1:
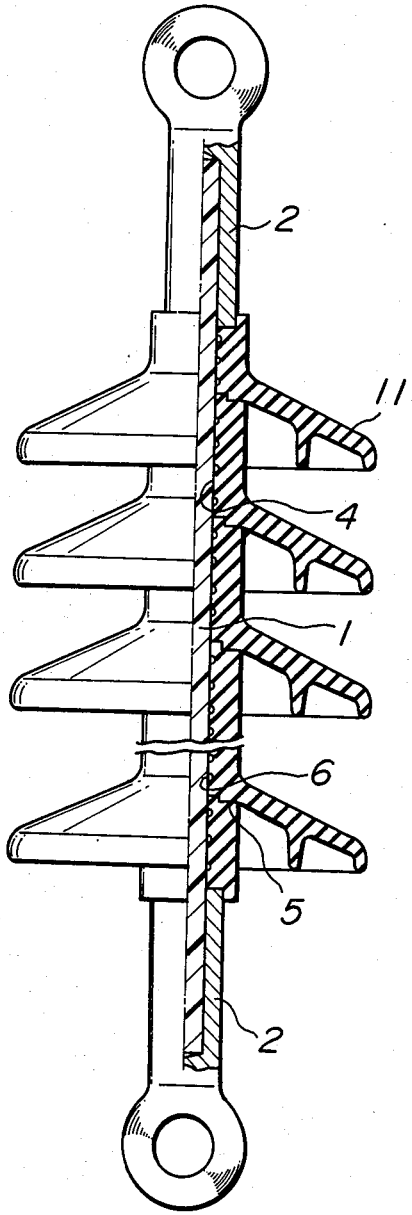
FIG. 1 PRIOR ART
FIG. 1 is a front view of a conventional synthetic resin insulator partly shown in section.
Figure 2:
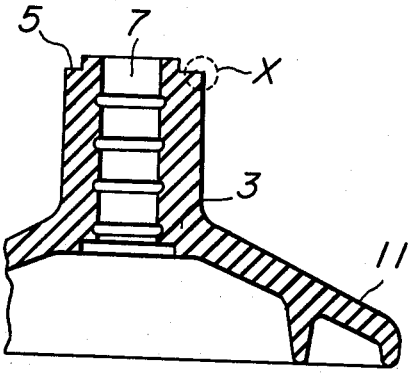
FIG. 2 PRIOR ART
FIG. 2 is an enlarged cross-sectional view of an essential part of an overcoat of the conventional synthetic resin insulator shown in FIG. 1.

The conventional synthetic resin insulator comprises, as illustrated in FIGS. 1 and 2, a reinforced plastic rod 1, holding metal fittings 2 and 2 fixed to both ends of the rod 1 and a plurality of overcoats 3 superposed one upon another and fitted with each other such that the overcoats cover the total surface of the reinforced plastic rod 1 located between the holding metal fittings 2 and 2 and the outer circumferential portion of the holding metal fitting 2 at its end for receiving the reinforced plastic rod 1, each of the overcoats consisting of an elastic insulating material, such as ethylene propylene rubber or the like, having a given shape and being provided at its outside with one shed 11. In this insulator, in order to prevent formation of gaps at the interface 4 between the reinforced plastic rod 1 and the overcoats 3, or in order to seal the contact portion 5 of adjacent overcoats 3, a pasty dielectric material 6, such as silicone grease or the like, is filled in the interface 4 as shown in FIG. 1, or the rod 1 is bonded with the overcoats 3 at the interface 4 and adjacent overcoats 3 are bonded with each other at the contact portion 5 through an adhesive or the like. In both of the above-described insulators, individual overcoats, each having one shed, are superposed one upon another, and therefore the insulators have the following serious drawbacks.

That is, in the former insulator, wherein a pasty dielectric material 6, such as silicon grease or the like, is filled in the interface 4, in order to prevent leakage of the silicone grease from the interface 4 or to prevent penetration of water and the like into the interface 4, the overcoats 3 are elongated by about 7% in their radial direction by the reinforced plastic rod 1 inserted thereinto to clamp firmly the rod 1 by the overcoats 3, and further the overcoats 3 are compressed in their axial direction between both the holding metal fittings 2 and 2 to cause pressures between the reinforced plastic rod 1 and the overcoats 3 in contact with the rod 1 and between adjacent overcoats 3. However, this sealing structure is insufficient in the sealing effect for practical use. Further, since the overcoats 3 are compressed in the axial direction, the diameter thereof is further enlarged to elongate more and more the outer surface of the overcoats to the circumferential direction.

When the overcoats 3 are elongated to the circumferential direction, the outer surface of the overcoats 3 is naturally elongated. Such elongated state promotes the breakdown of molecular chain of elastic insulating materials, such as silicone rubber, ethylene propylene rubber and the like, and the elastic insulating materials are easily eroded and deteriorated. Further, the shoulder x at the contact portion 5 of adjacent overcoats 3 is easily oxidized and deteriorated due to its large specific surface area. Moreover, since the overcoats are compressed in their axial direction, stress is concentrated into the shoulder x, and the shoulder is elongated in a large amount and is apt to be deteriorated more easily. In general, this erosion proceeds in a direction perpendicular to the stretching direction. In addition, the surface of the overcoats 3 is eroded due to minute discharges generated on the overcoat surface during rainfall, and the erosion grows rapidly in the form of a groove in a direction perpendicular to the stretching direction, that is, towards the interface 4 between the reinforced rod 1 and the overcoats 3 due to the above-described deterioration of the shoulder. This directional erosion reaches the interface 4 between the overcoats 3 and the reinforced plastic rod 1 in a very short period of time to cause leakage of the pasty dielectric material 6, such as silicone grease or the like, and penetration of water and to promote insulation breakdown of the interface 4, and further to erode and break the reinforced plastic rod. As a result, the faculty of the insulator is lost.

Moreover, the pasty dielectric material 6, such as silicon grease or the like, filled in the interface 4 between the reinforced plastic rod 1 and the overcoats 3 diffuses and penetrates, although very slowly, into the molecular chain of the elastic insulating material constituting the overcoats 3, and reversely various gases present in the external atmosphere diffuse and penetrate into the overcoats 3 towards the interface 4 between the reinforced plastic rod 1 and the overcoats 3. As a result, gaps are formed in the pasty dielectric material 6, and water diffused and penetrated into the insulator from the external atmosphere is agglomerated in the gap to form water drops, which deteriorates noticeably the electric insulating property of the insulator. Furthermore, when the insulator is practically used in the power transmission line and the like, the insulator is exposed to direct sunlight to cause temperature rise of the insulator, and silicone grease filled in the interface 4 is expanded due to the temperature rise to expand the overcoats 3. In this case, since a plurality of overcoats are superposed one upon the other, silicone grease leaks from the contact portion 5 of adjacent overcoats 3. Moreover, it is observed that there is a problem that, when a hot-line washing is carried out by the use of high-pressure water in order to wash away pollutant adhered to insulators used in a substation and the like in a region, wherein insulators are violently polluted, the overcoats 3 are forcedly moved by the high-pressure water blown thereto to form gaps at the contact portion 5 of adjacent overcoats, and water is penetrated into the interface 4 through the gaps.

While, in the latter insulator, wherein the reinforced plastic rod 1 is bonded with the overcoats 3 at the interface 4 through an adhesive and adjacent overcoats 3 are bonded with each other at the contact portion 5 through an adhesive, since the adhesive is generally an active material, the adhesive, even after solidified, is apt to be deteriorated more easily than the overcoat material; and when the adhesive is exposed to the external atmosphere at the contact portion of adjacent overcoats, the adhesive layer is firstly eroded by the actions of the above-described oxygen and water in the external atmosphere and of the minute discharges to form gaps in the adhesive layer; and the shoulder x which has a large specific area and is liable to be oxidized and deteriorated is successively eroded and deteriorated. This erosion reaches the interface 4 in a short period of time similarly to the above-described former insulator, wherein a pasty dielectric material 6 is filled in the interface 4, to cause insulation breakdown at the interface 4 and further to erode gradually the reinforced plastic rod 1, resulting in the dissolution of continuity of the insulator.

The present invention provides a synthetic resin insulator free from the above-described drawbacks of conventional synthetic resin insulators.

The synthetic resin insulator of the present invention will be explained in detail by the following examples referring to FIGS. 3*a*–12. Among the references in these figures, the same references as those shown in FIGS. 1 and 2 represent the same portion as or corresponding portion to those shown in FIGS. 1 and 2.

Figure 3A:
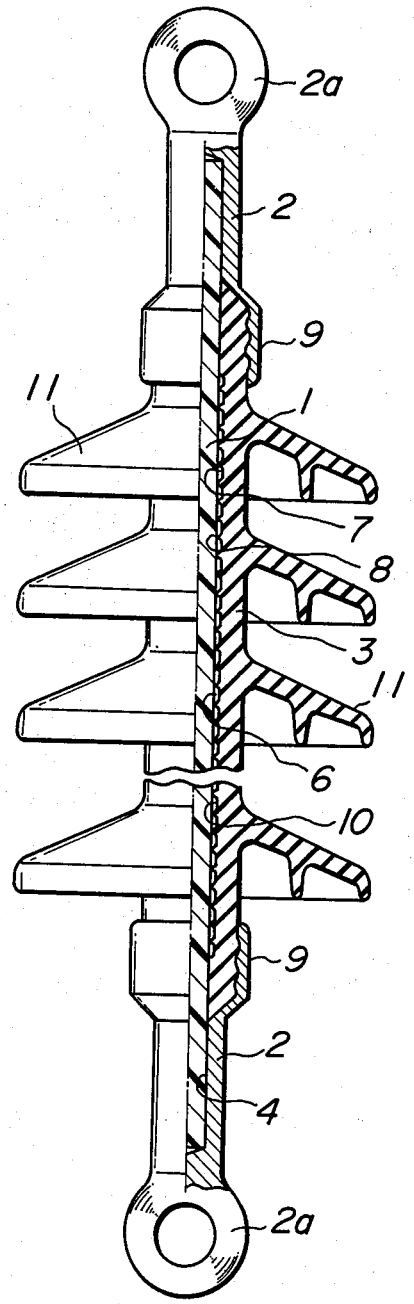
FIG. 3*a* is a front view of a synthetic resin insulator of the present invention partly shown in section.
Figure 3B:
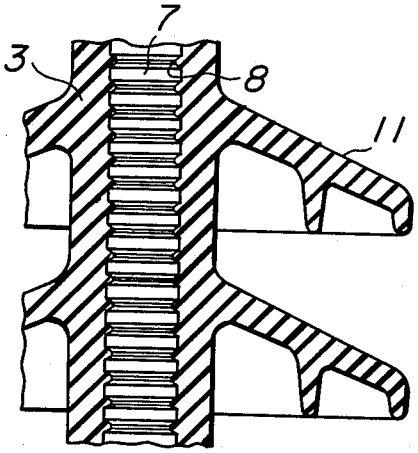
FIG. 3*b* is an enlarged cross-sectional view of an essential part of an overcoat of the synthetic resin insulator of the present invention shown in FIG. 3*a;*
Figure 4:
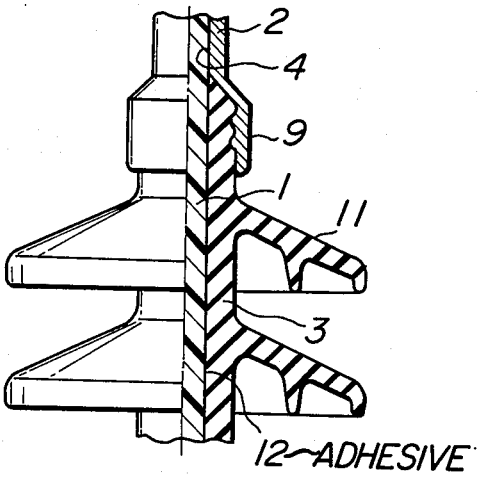
FIG. 4 is a front view of an essential part of another synthetic resin insulator of the present invention, the right half of which is shown in section.

The synthetic resin insulator of the present invention, as illustrated in FIGS. 3*a*–4, comprises a reinforced plastic rod 1, holding metal fittings 2 and 2, which hold both ends of the reinforced plastic rod 1, and a seamless unitary overcoat 3 consisting of a rubbery elastic insulating material, such as silicone rubber, ethylene propylene rubber or the like, and covering the total surface of the reinforced plastic rod 1 located between the holding metal fittings 2 and 2, said reinforced plastic rod 1 being produced by impregnating bundles of fibers, such as glass and the like, arranged in their longitudinal direction or knitted fiber bundles with a synthetic resin, such as epoxy resin, polyester resin or the like, and bonding the impregnated fiber bundles through the resin, and said holding metal fittings 2 and 2 being bonded to both ends of the reinforced plastic rod 1, and provided at their one end with a structure, for example, a ring- or clevis-shaped fitting member *2a*, for fitting directly or indirectly the holding metal fitting to electric wire, steel tower arm or other supporters, and at their other end with a metal sleeve 9 adapted to receive the overcoat end therein and to bond the reinforced plastic rod, the overcoat end and the sleeve together, and fixed airtightly to the reinforced plastic rod-receiving end side of the holding metal fitting 2 by screw bonding, through sealing tape, O-ring or the like, or by forming the reinforced plastic rod-receiving end side and the sleeve into one integral body. In this insulator, both ends of the overcoat 3 are sandwiched between the reinforced plastic rod 1 and the above-described metal sleeve 9, which is gastightly fixed to the reinforced plastic rod-receiving end side of the holding metal fitting 2, and the metal sleeves 9 are pressed in the radial direction to fix firmly both ends of the overcoat 3, and further the interface 4 between the reinforced plastic rod 1 and the overcoat 3 is gastightly isolated from the external atmosphere. That is, since the overcoat 3 is made of a rubbery elastic insulating material, the overcoat 3 can be deformed in a large amount within its elastic limit. Therefore, when the metal sleeve 9 is pressed, both ends of the overcoat 3 are tightly compressed and fixed to both the inner surface of the metal sleeve 9 and the surface of the reinforced plastic rod 1 under pressure over a wide temperature range, which covers low temperature, and are mechanically and highly gastightly fixed between the rod 1 and the sleeve 9.

A typical synthetic resin insulator of the present invention, wherein a pasty dielectric material 6 is filled in the interface 4 as shown in FIG. *3a*, is assembled in the following manner. A pasty dielectric material 6, preferably silicone grease, previously deaerated under vacuum is filled in an injector-like vessel having a piston. Then silicone grease is filled in the inner hollow portion 7 of an overcoat 3 placed in a vacuum chamber from one end of the overcoat under vacuum through a conduit by moving the piston, and then a reinforced plastic rod 1 is inserted into the inner hollow portion 7 of the overcoat 3 from the other end. In this case, the piston is backwardly moved, while keeping a previously determined pressure corresponding to the inserting movement of the reinforced plastic rod, whereby the silicone grease is sealed in the interface 4 between the reinforced plastic rod 1 and the overcoat 3 under a positive pressure.

Then, holding metal fittings 2 and 2 are fixed to both ends of the reinforced plastic rod 1 by a conventional press fitting or bonding. In this case, both ends of the overcoat 3 are sealed into the metal sleeves 9 and 9 fixed to the holding metal fittings 2 and 2 and are pressed and fixed to the reinforced plastic rod so as to prevent leakage of the grease and penetration of water and the like, and further to prevent moving of the ends of the overcoat. The seamless unitary overcoat 3, which consists of an elastic insulating material, such as silicone rubber, ethylene propylene rubber or the like, and covers the total surface of the reinforced plastic rod 1 located between the holding metal fittings 2 and 2, has an inner hollow portion 7, whose diameter is a little larger than the outer diameter of a reinforced plastic rod to be inserted thereinto, in its center portion as shown, for example, in FIG. *3b*, and has annular projections 8 formed in the inner hollow portion 7 of the overcoat in a direction perpendicular to the axial direction of the reinforced plastic rod 1, and further is provided at the outside with a plurality of sheds 11.

Figure 5:
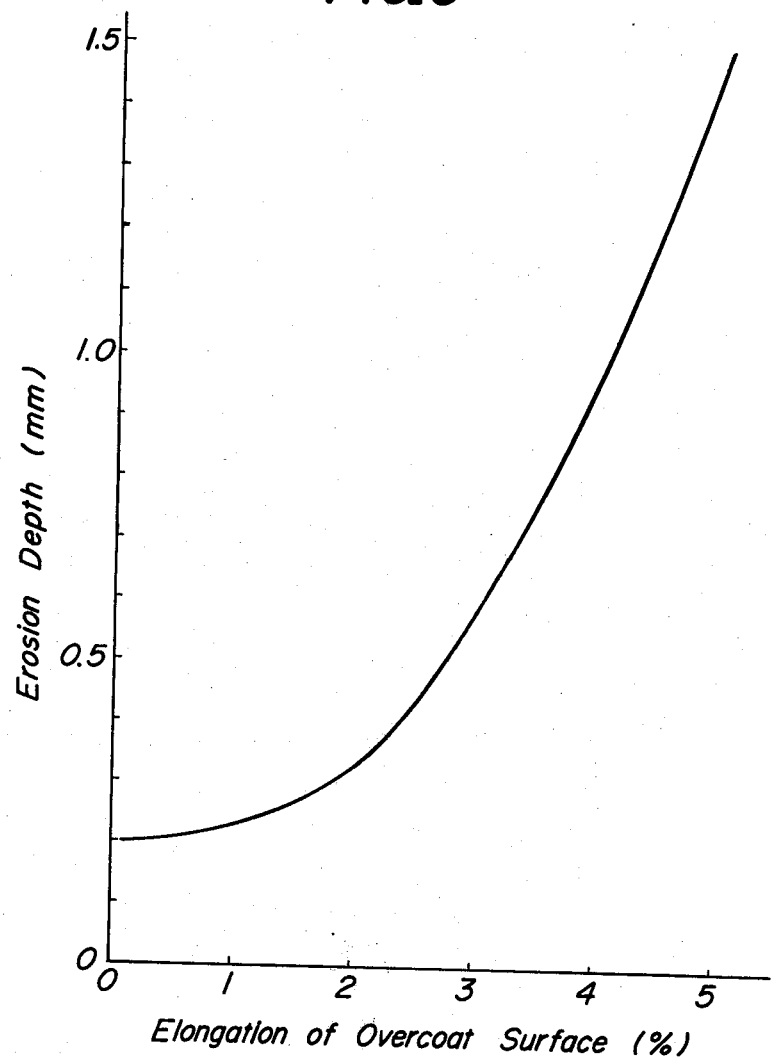
FIG. 5 is a graph illustrating a relation between the elongation of overcoat surface and the erosion depth.
Figure 6:
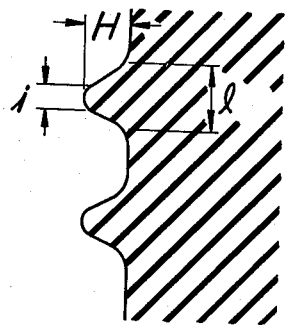
FIG. 6 is a partial sectional view of the annular projections shown in FIG. 3*a;*
Figure 7:
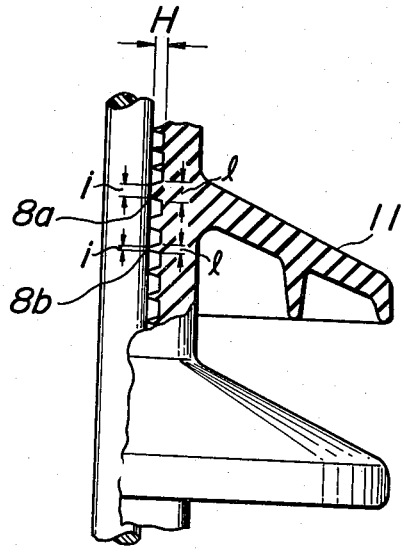
FIG. 7 is a front view of a part of the insulator according to the present invention shown in FIG. 3*a,* partly shown in section.

When an insulator having the above-described structure is assembled, the annular projections 8 are expanded by the reinforced plastic rod 1, and the outer surface of the overcoat 3 is elongated, and at the same time the tops of the annular projections 8 are pressed and deformed by the clamping force of the overcoat 3 consisting of rubbery elastic material. In the present invention, the elongation of the outer surface of the overcoat 3 is adjusted to not higher than 2% by selecting properly the dimensions of the outer diameter of the reinforced plastic rod 1, the inner diameter of the overcoat 3, and the annular projections 8. The reason why the elongation of the outer surface of the overcoat 3 is limited to not higher than 2% is as follows. When the elongation is higher than 2%, the breakdown of molecules of rubber (erosion of rubber) constituting the overcoat is promoted to cause early deterioration of the overcoat, and the effect of the present invention cannot be fully attained. This fact will be explained hereinafter referring to FIGS. 5 and 6. FIG. 5 illustrates the variation of erosion depth in the overcoat surface when the elongation of the overcoat surface is varied within the range of 0–5% with respect to the following overcoat model. An overcoat having an outer diameter of 36 mm, an inner diameter of 23 mm and a thickness of 6.5 mm and provided at its inner surface with annular projections 8 having a thickness l of 2.5 mm in the root, a thickenss i of 1 mm in the top, and a height H of 1.6 mm shown in FIG. 6 was sprayed with a brine for 10 seconds at a flow rate of 20 ml/min and then the spraying was stopped for 20 seconds under a condition that a voltage of 4,000 V was applied across electrodes spaced apart from each other by 100 mm, and this cycle was repeated 10,000 times to obtain the overcoat model.

It can be seen from FIG. 5 that, when the elongation of the overcoat surface is 2%, the erosion depth in the overcoat surface is about 0.3 mm, but when the elongation is 5%, the erosion depth is 1.45 mm and is as large as about 5 times the erosion depth in the case of 2% elongation. That is, when the elongation of the overcoat surface is higher, the erosion resistance thereof lowers noticeably, and it has been found that the elongation of the overcoat surface is preferably not higher than 2% for practical use.

The annular projections 8 are arranged in the inner surface of the overcoat in order to prevent the insulation breakdown of the insulator at the interface between the overcoat and the reinforced plastic rod due to the flowing out of silicone grease sealed in the interface when the overcoat is broken, and at the same time to improve the insulation performance of the interface by the surface pressure. It is preferable that the top of the annular projection clamps fully the reinforced plastic rod surface in order to retain effectively the pasty dielectric material 6, such as silicone grease or the like, sealed in the interface. However, when the clamping force is excessively large and is uniform over the entire length of the overcoat 3, its inner diameter is extended in a large amount, and its outer surface is stretched in a particularly large amount at the trunk portion having a small thickness. Accordingly, it is preferable that the clamping force of annular projections 8 arranged in the overcoat 3 at a portion corresponding to the root of a shed 11 and having a large thickness is larger than the clamping force of annular projections 8 arranged in the overcoat 3 at a portion other than the above-described portion corresponding to the root of a shed 11. For example, when annular projections are arranged in the overcoat 3 such that their thickness i and l are larger at a portion 8*a* corresponding to the root of a shed 11 and are small at a portion 8*b* corresponding to the trunk portion, silicone grease can be effectively retained, and further the elongation of the outer surface of the overcoat 3 can be adjusted to be not higher than 2%, which is the upper limit of elongation substantially free from the above-described directional erosion. Further, the development of the erosion can be prevented in the following manner. That is, annular projections 8 are arranged in the overcoat 3 such that their height H is large at the portion 8*a* corresponding to the root of a shed 11 and is small at the portion 8*b* corresponding to the trunk portion, that the distance between adjacent annular projections 8 is small at the portion 8*a* corresponding to the root of a shed 11 and is large at the portion 8*b* corresponding to the trunk portion, or that the above-described arrangements are combined. The reason why annular projections 8 having a large thickness or height are arranged or annular projections 8 are arranged in a small interval at the portion 8*a* corresponding to the root of a shed 11 is that, even when the overcoat 3 is expanded by a large pressing force at the portion 8*a*, the overcoat surface does not substantially elongate.

Figure 8:
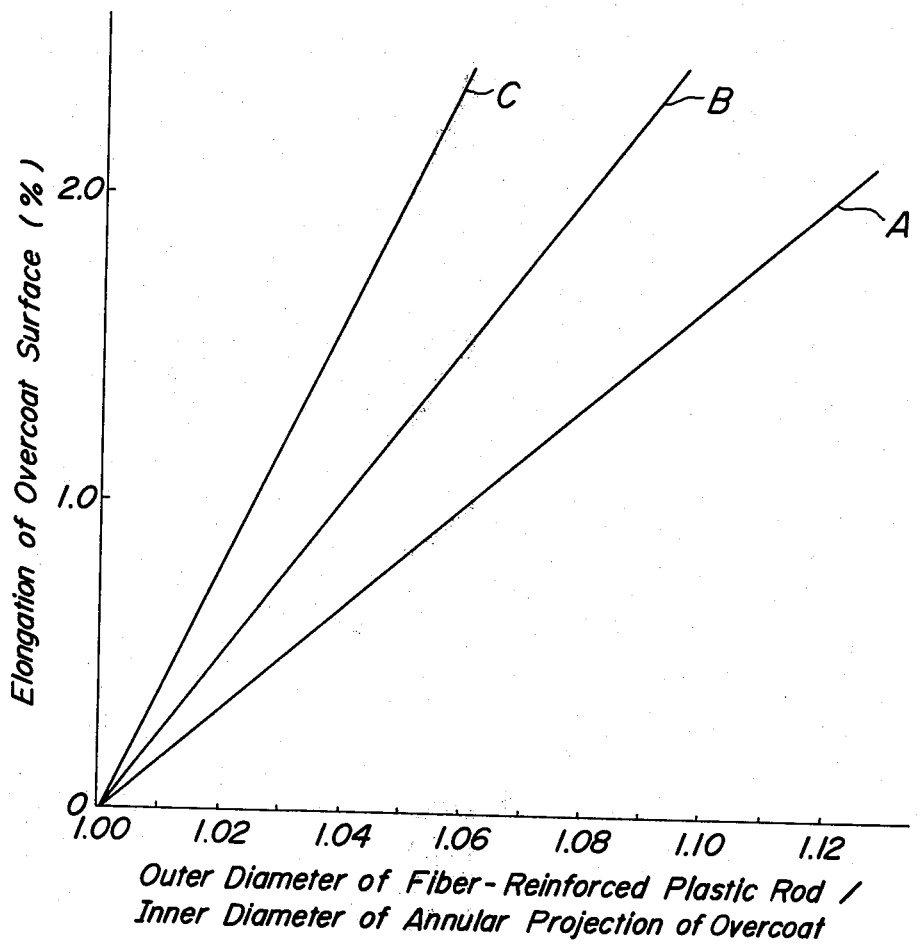
FIG. 8 is a graph illustrating a relation between the ratio of the diameter of a reinforced plastic rod to the inner diameter of annular projections of an overcoat and the elongation of the outer surface of the overcoat.
Figure 9:
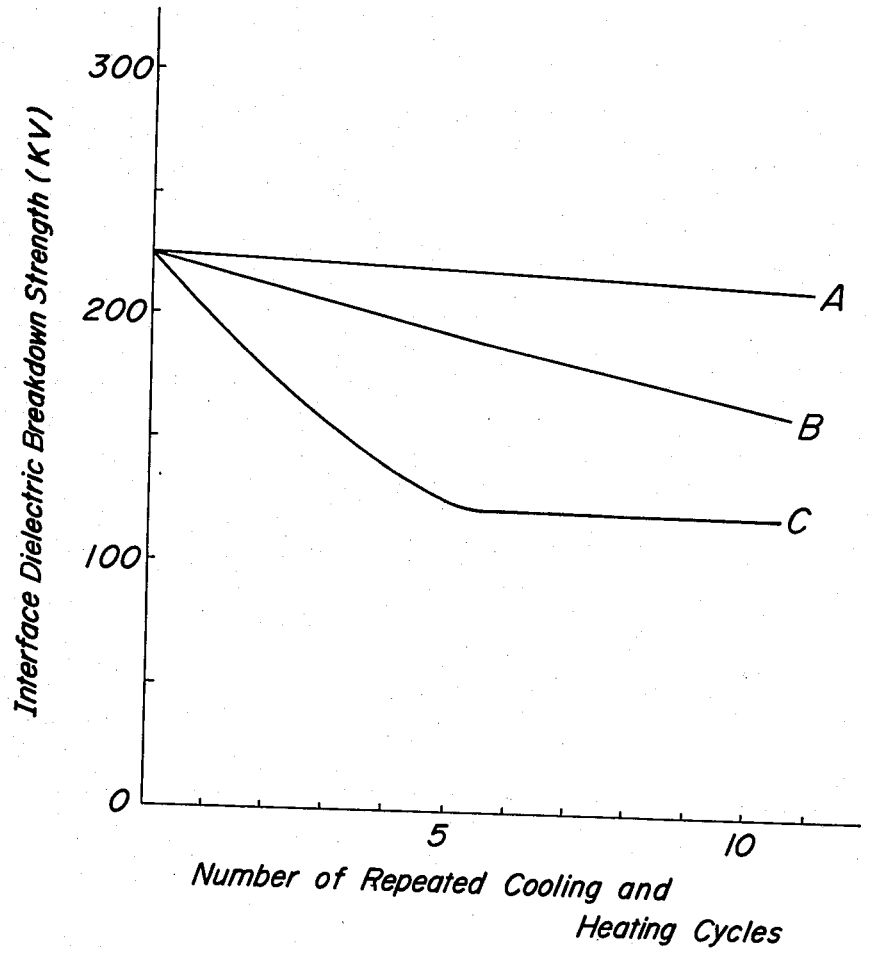
FIG. 9 is a graph illustrating a relation between the number of repeated cooling and heating cycles and the interface dielectric breakdown strength.

The smaller thickness of the top of the above-described annular projections 8 is more preferable, because the smaller is the thickness, the smaller the elongation of the overcoat surface is. This fact will be explained referring to FIG. 8. Into an overcoat 3 having an outer diameter of 36 mm, an inner diameter of 23 mm and provided at its inner hollow portion with annular projections 8 arranged at an interval of 5 mm, each projection 8 having a thickness l of 2.5 mm at the root, a height H of 1.6 mm and a variant thickness i at the top, a reinforced plastic rod 1 having a variant outer diameter was inserted, and the elongation of the outer surface of the overcoat was measured. FIG. 8 shows the results. In FIG. 8, line A shows the elongation of the outer surface of an overcoat (referred to as overcoat A), whose annular projections 8 have a thickness of 1.0 mm at the top and a curvature of 0.5 R at the top; line B shows that of an insulator (referred to as insulator B), whose annular projections 8 have a thickness of 1.5 mm at the top and a curvature of 0.75 R at the top; and line C shows that of an overcoat (referred to as overcoat C), whose annular projections have a thickness of 2 mm at the top and a curvature of 1.0 R at the top. It can be seen from FIG. 8, that, when the ratio, shown in the abscissa, of the outer diameter of a reinforced plastic rod to the inner diameter of annular projections is 1.06, the elongation of the overcoat surface is 1.0% in overcoat A having the smallest top thickness of annular projections, but is 1.5% in overcoat B and is 2.4% in overcoat C. That is, the smaller is the thickness of the top, the smaller the elongation of the overcoat surface is. Then, among the insulators used in the experiment shown in FIG. 8, insulators produced under the following condition that overcoats were A, B and C, elongation of overcoat surface was 2% and sealing pressure for grease was 3 kg/cm$^2$, were used, and each of the insulators was immersed in cold water kept at room temperature for 1 hour and then in hot water kept at 90° C. for 1 hour, and this cooling and heating cycle was repeated, thereby forcedly introducing water into the insulator. The dielectric breakdown strength at the interface 4 between the reinforced plastic rod 1 and the overcoat 3 of the insulator was measured. The obtained results are shown in FIG. 9. It can be seen from FIG. 9 that the interface dielectric breakdown strength of an insulator using overcoat C (this insulator is referred to as insulator C), whose annular projections have the largest top thickness, is decreased by 40% by repeating 5 times of the cooling and heating cycles, but that of an insulator using overcoat A (this insulator is referred to as insulator A), whose annular projections have the smallest top thickness, is not substantially decreased by the repeated cooling and heating cycles.

That is, it can be seen from the results of the above-described experiments that insulator A whose annular projections 8 have the smallest top thickness i, is smallest in the decrease of the interface dielectric breakdown strength. The reason is as follows. When overcoats 3 have the same thickness, that is, when reinforced plastic rods 1 are clamped through annular projections 8 by an equal force, as the thickness i of the top of the annular projections 8 is the smaller, the amount of annular projections 8 deformed at the top portion, which is in contact with the reinforced plastic rod 1, is the larger, and a high sealing effect is developed, and penetration of water into the interface can be prevented.

In the above-described synthetic resin insulator, a pasty dielectric material 6 is sealed into the interface 4 between a reinforced plastic rod 1 and an overcoat 3 as shown in FIG. 3*a* under a positive pressure. Such sealing structure and filling of grease under a positive pressure can prevent negative pressure formation due to diffusion and penetration of grease into the overcoat 3. The negative pressure formation occurs in a space 10 confined by the reinforced plastic rod 1 and the annular projections 8 of the overcoat 3. As a result, formation of gaps in the grease, that is, formation of water drops at the interface 4 between the reinforced plastic rod 1 and the overcoat 3 can be prevented, and high reliability of the electrical insulating performance of the insulator can be kept for a long period of time.

In the above-described insulator, a higher sealing pressure for grease is more preferable in order to seal densely the grease into the interface. However, excessively high sealing pressure expands excessively the inner hollow portion 7 of the overcoat 3 to cause unfavorable circumferential elongation in the outer surface of the overcoat 3. Therefore, such a sealing pressure is preferable that gives an elongation of the overcoat surface of not higher than 2%, which is the upper limit having substantially no adverse effect on the erosion resistance of the overcoat.

In addition to the above-described example of insulator, the insulator of the present invention can be variously modified within the scope of the present invention. For example, in the above-described example, a pasty dielectric material 6, such as silicone grease or the like, is filled in the interface 4 between the overcoat 3 and the reinforced plastic rod 1. However, in the insulator of the present invention, an overcoat 3 can be bonded with a reinforced plastic rod 1 through an adhesive 12, such as epoxy resin or the like, as shown in FIG.

4, or an overcoat 3 can be directly bonded with a reinforced plastic rod 1 through vulcanization. In the production of insulators having such bonding structure, it is preferable to apply a force in a direction opposed to a direction, which breaks mechanically the bonding, in order to protect the bonded portion. Accordingly, an insulator is assembled by clamping a reinforced plastic rod 1 in the radial direction by an overcoat 3. In general, peeling of the overcoat 3 from the rod 1 at the bonded portion occurs from the end of the bonded portion. In the present invention, since the end of the overcoat 3 is pressed by the metal sleeve 9 and firmly fixed, the reinforced plastic rod 1 can be clamped by the overcoat 3 by a small clamping force. Accordingly, the elongation of the surface of the overcoat 3 can be easily adjusted to be not higher than 2% without troubles.

Figure 10:
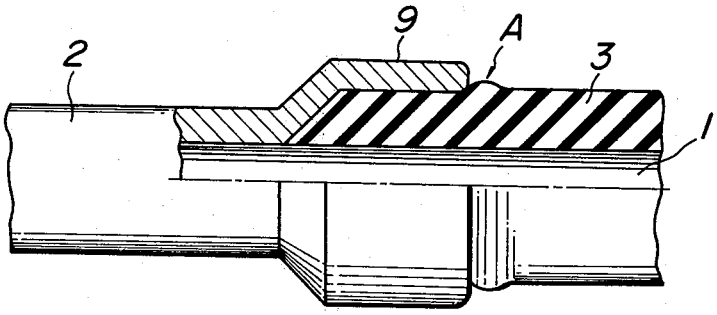
FIG. 10 is a front view of the end portion of an overcoat partly shown in section and showing the effect of a metal sleeve thereon.
Figure 11:
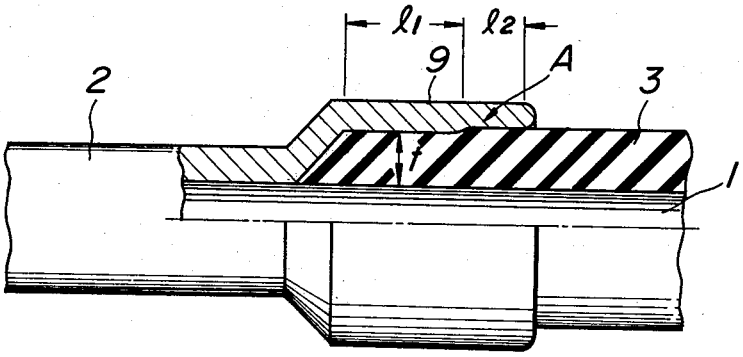
FIG. 11 is a front view similar to FIG. 10 and showing a preferred structure of a metal sleeve according to the present invention.

In both of the above-described insulators, wherein grease is filled in the interface 4 between the reinforced plastic rod 1 and the overcoat 3, or wherein a reinforced plastic rod 1 is bonded with an overcoat 3 through an adhesive, both ends of the overcoat 3 are sandwiched between the reinforced plastic rod 1 and the metal sleeve 9 fixed to the reinforced plastic rod-receiving end side of holding metal fitting 2, and pressed in the radial direction by the metal sleeve 9 and fixed in the sleeve. In this case, in the end portion of the overcoat 3, which is pressed in the radial direction by the metal sleeve 9, a portion A adjacent to the pressed portion expands as shown in FIG. 10. That is, the outer surface of the overcoat 3 elongates. Accordingly, it is preferable that the metal sleeve 9 is formed of a portion for compressing the end of an overcoat 3, and a portion for covering the expanded portion of the overcoat 3. In this case, it is preferable that the portion for compressing the overcoat end has a length $l_1$ equal to or larger than the thickness t of the overcoat end in order to fix the overcoat end firmly and highly airtightly. Further, it is preferable that the portion for covering the expanded portion has a length $l_2$ equal to or larger than one-half of the thickness t of the overcoat end in order to compensate substantially the expansion. In addition to the above-described structures, in the insulator filled with a pasty dielectric material 6, the end of an overcoat 3 is liable to slip and is easily moved by an external force, and therefore it is preferable to form projections in the outer end of the overcoat 3 and at the same time to form projections in the inner surface of the metal sleeve 9 so as to be fitted into the projections formed in the outer end of the overcoat 3, whereby the end of the overcoat 3 is prevented from falling out from the metal sleeve 9 by an external force.

The merit of the synthetic resin insulator of the present invention over conventional synthetic resin insulators will be illustrated by the following experimental examples.

EXPERIMENTAL EXAMPLE 1

A sample insulator was alternately immersed in cold water kept at room temperature for 1 hour and in hot water kept at 90° C. for 1 hour, and this cycle was repeated. A voltage corresponding to 70% of the dielectric breakdown strength of the interface between the reinforced plastic rod and the overcoat of the sample insulator before the cooling and heating cycles, was applied to the above treated insulator, and the number of repeated cooling and heating cycles until the insulation of the interface was broken was measured. The obtained results are shown in the following Table 2.

The sample insulators used in the above-described measurement were produced in the following manner. Insulator A of the present invention, which had a structure shown in FIG. 3a, was produced in the following manner. An electroconductive paint was applied to both ends of a reinforced plastic rod formed of a cycloaliphatic type epoxy resin reinforced with glass fibers and having a diameter of 19 mm to form electrodes spaced apart from each other by 200 mm on both ends of the rod. An overcoat made of ethylene propylene rubber and having a dimension shown in the following Table 1 was used, and the interface between the overcoat and the reinforced plastic rod having the electrodes was filled with silicone grease as a pasty dielectric material. Both ends of the overcoat were pressed and fixed by holding metal fittings having a metal sleeve shown in FIG. 11, which had a length $l_1$ of 16 mm in the portion for pressing the end of the overcoat and a length $l_2$ of 8 mm in the portion for covering the expanded end portion of the overcoat, in a linear distance between the metal sleeves of 200 mm, and the elongation of the overcoat surface was adjusted such that the maximum elongation was 2% in the trunk portion of the overcoat.

Insulator B of the present invention was produced in the same manner as described above except that the reinforced plastic rod having the electrodes was bonded with the overcoat through an epoxy resin adhesive as shown in FIG. 4 in place of filling the pasty dielectric material in the interface between the overcoat and the reinforced plastic rod having the electrodes.

For comparison, as conventional synthetic resin insulators, insulators C and D were produced in the following manner. The same overcoat material and reinforced plastic rod having the electrodes as those used in the above-described insulators A and B were used, and a plurality of individual overcoats, each having a trunk outer diameter and a shed diameter shown in Table 1, were superposed one upon the other as shown in FIG. 1. The linear distance between the metal sleeves was made into same value as that in insulators A and B. In the assembling of insulators C and D, silicone grease was filled in the interface between the overcoats and the reinforced plastic rod having the electrodes to produce insulator C, or the reinforced plastic rod was bonded with the overcoats at their interface and the adjacent overcoats were bonded with each other at their contact portion through the epoxy resin adhesive to produce insulator D. In the production of the above-described conventional insulators C and D, the elongation of the overcoat surface was adjusted to 7% in the both end portions enclosing the metal fittings and to 5% in the trunk portion.

Further, assuming the injured state of insulator, insulators, which had a hole having a diameter of 0.5 mm and penetrated through the trunk portion of the center overcoat so as to reach the interface in insulators A and C, were produced. The resulting insulators are referred to as insulators A' and C', respectively.

TABLE 1

| Item | Dimension |
|---|---|
| Outer diameter of trunk portion of overcoat | 36 mm |
| Shed diameter of overcoat | 138 mm |
| Number of sheds | 3 |
| Pitch of sheds | 60 mm |

TABLE 2

| Sample insulator | | Number of repeated cooling and heating cycles up to insulation breakdown |
|---|---|---|
| Insulator of the present invention | A | at least 100 |
| | A' | 55 |
| | B | at least 100 |
| Conventional insulator | C | 30 |
| | C' | 25 |
| | D | 75 |

It can be seen from Table 2 that the insulator of the present invention is smaller in the lowering of dielectric breakdown strength at the interface than the conventional insulator in both the insulator wherein the interface is filled with the pasty dielectric material, and the insulator wherein the reinforced plastic rod is bonded with the overcoat through the epoxy resin adhesive. Particularly, in the insulator filled with a pasty dielectric material, conventional insulator C causes insulation breakdown of the interface after 30 times of repeated cooling and heating cycles, but insulator A of the present invention does not cause insulation breakdown of the interface even after 100 times of repeated cooling and heating cycles. That is, it can be expected that the insulator of the present invention has a resistance life against insulation breakdown as large as about 3 times that of the conventional insulator. Moreover, it can be expected that the injured synthetic resin insulator (insulator A') filled with the pasty dielectric material in the present invention has substantially the same resistance life against insulation breakdown as that of the conventional synthetic resin insulator C filled with the pasty dielectric material and having no injury.

EXPERIMENTAL EXAMPLE 2

Brine was sprayed on each of the following sample insulators for 10 seconds at a flow rate of 120 ml/min while applying a voltage of 60 KV, and then the spraying of brine was stopped for 20 seconds, and this alternate cycle was repeated to cause leakage current to be forcedly flown along the overcoat surface and to cause minute discharges, whereby the overcoat was eroded. Time until the erosion reaches the interface between the overcoat and the reinforced plastic rod of the sample insulator was measured. The obtained results are shown in the following Table 4.

Insulator E of the present invention, which had a structure shown in FIG. 3*a*, was produced in the following manner. A reinforced plastic rod formed of a cyclo-aliphatic type epoxy resin reinforced with glass fibers and having a diameter of 19 mm, and an overcoat made of ethylene propylene rubber and having a dimension shown in the following Table 3 were used, and the interface between the reinforced plastic rod and the overcoat was filled with silicone grease as a pasty dielectric material. Both ends of the overcoat were pressed and fixed by holding metal fittings having a metal sleeve shown in FIG. 11, which had a length $l_1$ of 16 mm in the portion for pressing the end of the overcoat and a length $l_2$ of 8 mm in the portion for covering the expanded end portion of the overcoat, and the elongation of the overcoat surface was adjusted such that the maximum elongation was 2% in the trunk portion of the overcoat.

Insulator F of the present invention was produced in the same manner as described in insulator E, except that the reinforced plastic rod was bonded with the overcoat through an epoxy resin adhesive as shown in FIG. 4, in place of filling the pasty dielectric material in the interface between the rod and the overcoat.

For comparison, as conventional insulators, insulators G and H were produced in the following manner. The same overcoat material and reinforced plastic rod as those used in the above-described insulators E and F were used, and a plurality of individual overcoats, each having a trunk outer diameter and a shed diameter shown in Table 3 were superposed one upon the other as shown in FIG. 1 so as to form the same surface leakage distance as that in insulators E and F. In the assembling of insulators G and H, silicone grease was filled in the interface between the reinforced plastic rod and the overcoats to produce insulator G, or the reinforced plastic rod was bonded with the overcoats at their interface and adjacent overcoats were bonded with each other at their contact portion through the epoxy resin adhesive to produce insulator H. In the production of the above-described conventional insulators G and H, the elongation of the overcoat surface was adjusted to 7% in both end portions enclosing the metal fittings and to 5% in the trunk portion.

TABLE 3

| Item | Dimension |
|---|---|
| Outer diameter of trunk portion of overcoat | 36 mm |
| Shed diameter of overcoat | 138 mm |
| Surface leakage distance | 1,930 mm |
| Number of sheds | 10 |
| Pitch of sheds | 60 mm |

TABLE 4

| Sample insulator | | No. | Time until erosion reaches interface (days) | Insulation breakdown |
|---|---|---|---|---|
| Insulator of the present invention | E | 1 | 88 | no |
| | | 2 | 93 | no |
| | | 3 | 91 | no |
| | F | 1 | 90 | no |
| | | 2 | 96 | no |
| | | 3 | 87 | no |
| Conventional insulator | G | 1 | 28 | no |
| | | 2 | 20 | occur |
| | | 3 | 17 | occur |
| | H | 1 | 25 | occur |
| | | 2 | 30 | no |
| | | 3 | 35 | occur |

Figure 12:
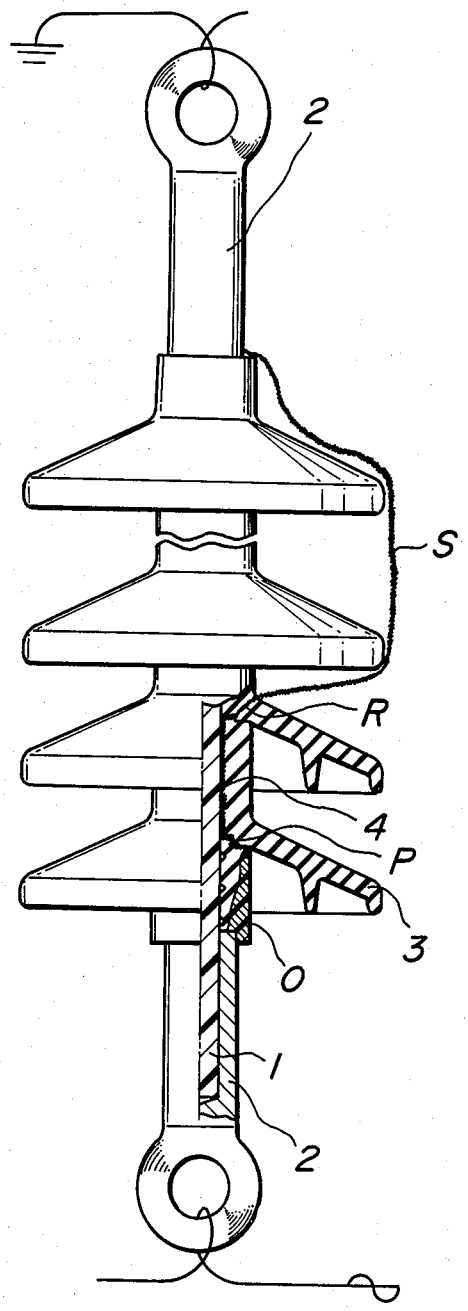
FIG. 12 PRIOR ART
FIG. 12 is a front view of a conventional synthetic resin insulator partly shown in section and showing a route of insulation breakdown thereof.

It can be seen from Table 4 that, in the conventional synthetic resin insulators G and H, erosion reaches the interface between the reinforced plastic rod and the overcoats in about one month, but in the synthetic resin insulators E and F of the present invention, erosion reaches the interface in about 3 months. Therefore, according to the present invention, synthetic resin insulators having a life as long as about 3 times of that of conventional synthetic resin insulators can be obtained. Further, in the conventional resin insulator, insulation breakdown often occurred through a route of (eroded portion O)-(bonded portion P of overcoats)-(interface 4 between reinforced plastic rod and overcoat)-(root R of shed)-(external space S) as shown in FIG. 12 before erosion reaches the interface. Moreover, when the above-described test was continued after the erosion reached the interface, the erosion merely proceeds continuously in the synthetic resin insulators of the present invention, but insulation breakdown occurred in substantially all the conventional synthetic resin insulators through the route shown in FIG. 12.

As described above, the present invention has solved the drawbacks of conventional synthetic resin insulators of this kind. In the present invention, an overcoat consisting of a seamless unitary molded article is arranged between holding metal fittings and pressed by metal sleeves fixed airtightly to the metal fittings, whereby both ends of the above-described overcoat are firmly fixed to isolate the interface between the reinforced plastic rod and the overcoat from the external atmosphere without substantially applying a pressure in the axial direction of the overcoat. As a result, the life and reliability of electric insulation at the interface can be remarkably improved. Particularly, in the insulator wherein a pasty dielectric material, such as silicone grease, is filled in the interface between the reinforced plastic rod and the overcoat, the pasty dielectric material is sealed into the interface under a positive pressure, and moreover in both the insulator wherein a pasty dielectric material is filled in the interface, and the insulator wherein the reinforced plastic rod is bonded with the overcoat through an adhesive, the elongation of the overcoat surface is adjusted to be not higher than 2% in the present invention. Therefore, in the insulator of the present invention, directional erosion, which occurs towards the interface in the conventional insulator, does not occur, and further leakage of a pasty dielectric material such as grease, penetration of water and other substances can be completely prevented. Accordingly, the insulator of the present invention has a very long life.

In the present invention, since an overcoat consisting of a seamless unitary molded article is used contrary to conventional insulators, oxidation of the shoulder portion at the seam of overcoats and oxidation of adhesive at the seam do not occur, and erosion resistance against weathering of the overcoat surface and against minute discharge can be remarkably improved. In general, in the synthetic resin insulator, in order to ensure the electric resistance of the interface, a pasty dielectric material is filled in the interface, or bonding treatment or the like is carried out at the interface. In the insulator of the present invention, an overcoat consisting of a seamless unitary molded article is used. Therefore, the insulator of present invention wherein a pasty dielectric material is filled in the interface, is free from leakage of pasty dielectric material through the seam, and penetration of water and the like, and has a very high reliability in the insulation of the interface. In the conventional insulator filled with a pasty dielectric material and having seams in the superposed overcoats, the reinforced plastic rod is clamped by annular projections formed in the inner hollow portion of the overcoats in order that movement of the pasty dielectric material in the axial direction of the rod is prevented to decrease the amount of the pasty dielectric material to be leaked out through the seams and that movement, at the interface in the axial direction of the rod, of water penetrated into the insulator through the seams is suppressed. However, in the insulator of the present invention, since an overcoat consisting of a seamless unitary article is used, the above-described problems due to the seam do not occur, and annular projections formed in the inner hollow portion of the overcoat mainly serve to suppress the leakage of pastry dielectric material through holes formed by injuring the overcoat, or to suppress the penetration of water in the external atmosphere into the interface through the hole. Accordingly, by the use of an overcoat consisting of a seamless unitary molded article, the force of the annular projection for clamping the reinforced plastic rod can be small, whereby the elongation of the overcoat surface can be small, and the resistance of the overcoat surface against erosion due to wheathering and minute discharge is more improved. Further, in the present invention, annular projections are formed such that a large clamping force acts on the large thickness portion (corresponding portion to the root of shed) of the overcoat and a small clamping force acts on the small thickness portion (trunk portion) of the overcoat, whereby the elongation of the overcoat surface can be controlled.

While, in the insulator, wherein a reinforced plastic rod is bonded with an overcoat through an adhesive, since the overcoat is formed of a seamless unitary molded article, the adhesive layer at the interface is completely isolated from the external atmosphere, and the insulator is free from such phenomenon in the conventional insulator that deterioration of adhesive layer in the seams of overcoats transfers to the bonding layer at the interface, and is very high in the life and reliability of the bonding layer at the interface. Further, a reinforced plastic rod must be clamped by an overcoat in order to prevent the deterioration of bonding layer at the interface. In the present invention, there can be used a clamping force lower than the clamping force used in the conventional insulators having seams in the superposed overcoats. Therefore, in the present invention, the elongation of the overcoat surface can be decreased, and insulators having an improved erosion resistance against weathering and minute discharge in the overcoat surface can be obtained.

Particularly, when the elongation of the overcoat surface is suppressed to not higher than 2% in both of the above-described treating methods of the interface, the erosion resistance of the insulator further improves.

In the present invention, weak point of an overcoat lies only in both ends thereof due to the reason that the overcoat is formed of a seamless unitary molded article, and therefore when both ends of an overcoat made of a rubbery elastic insulating material having a sufficiently high flexibility even at low temperatures are airtightly fixed to a reinforced plastic rod by pressing the both ends, by means of metal sleeves fixed to holding metal fitting, in the radial direction of the metal sleeves, the total interface between the overcoat and the reinforced plastic rod can be completely isolated from the external atmosphere. Therefore, the reliability of the interface improves in both the insulator wherein a pasty dielectric material is filled in the interface between the reinforced plastic rod and the overcoat, and the insulator wherein the rod is bonded with the overcoat through an adhesive. When the overcoat end is compressed and held in the metal sleeve, the overcoat sometimes expands at a portion adjacent to the compressed portion to elongate and deteriorate the overcoat surface. This drawback can be prevented by covering and protecting the portion adjacent to the portion to be compressed by a metal sleeve.

As described above, the synthetic resin insulator of the present invention is free from deterioration of overcoat surface, deterioration of interface, leakage of pasty dielectric material and other various dangerous drawbacks, and is excellent in erosion resistance, light in weight and high in strength. Accordingly, the synthetic resin insulator can be widely used as an insulator for ultra-high voltage transmission line and the like due to its excellent erosion resistance, light weight and high strength, and is very useful in industry.

What is claimed is:

1. A synthetic resin insulator comprising a fiber-reinforced plastic rod, metal fittings which hold both ends of the fiber-reinforced plastic rod, and a seamless unitary overcoat which consists of an elastic insulating material, covers the total surface of the fiber-reinforced plastic rod located between the metal fittings and is provided at its outside with a plurality of sheds, said metal fittings having metal sleeves gastightly fixed thereto and being operative to receive both ends of the overcoat, both ends of said overcoat being sandwiched between the metal sleeve and the fiber-reinforced plastic rod and fixed and sealed in the metal sleeve by pressing the sleeve in the radial direction so as to isolate gastightly the interface between the overcoat and the fiber-reinforced plastic rod from the external atmosphere, and wherein the elongation of the outer surface of the overcoat resulting from assembly with said fiber-reinforced plastic rod and pressing of said sleeves is not higher than 2%.

2. A synthetic resin insulator according to claim 1, wherein the sleeve consists of a portion for pressing the end of the overcoat in its radial direction and a portion for covering that portion of the overcoat which is expanded when the end of the overcoat is pressed.

3. A synthetic resin insulator according to claim 2, wherein said sleeve has a length $l_1$ equal to or larger than the thickness t of the end of the overcoat sandwiched between the sleeve and the fiber-reinforced plastic rod in the portion for pressing the end of the overcoat in its radial direction, and has a length $l_2$ equal to or larger than one-half of the thickness t in the portion for covering the expanded portion of the overcoat.

4. A synthetic resin insulator according to claim 1, 2 or 3, wherein the fiber-reinforced plastic rod is clamped in its radial direction by annular projections arranged on the inner surface of the overcoat, and a pasty dielectric material is sealed into the interface between the overcoat and the fiber-reinforced plastic rod under a positive pressure.

5. A synthetic resin insulator according to claim 4, wherein the clamping force of annular projections arranged on the inner surface of the overcoat at a portion corresponding to the root of the shed is larger than that of annular projections arranged on the inner surface of the overcoat at the trunk portion of said overcoat.

6. A synthetic resin insulator according to claim 1, 2 or 3, wherein the fiber-reinforced plastic rod is clamped by the overcoat in the radial direction of the rod and is bonded to the overcoat.

* * * * *